US006894237B2

(12) United States Patent
Wong et al.

(10) Patent No.: US 6,894,237 B2
(45) Date of Patent: May 17, 2005

(54) FORMATION OF SIGNAL PATHS TO INCREASE MAXIMUM SIGNAL-CARRYING FREQUENCY OF A FLUID-BASED SWITCH

(75) Inventors: Marvin Glenn Wong, Woodland Park, CO (US); Julius K. Botka, Santa Rosa, CA (US); Lewis R. Dove, Monument, CO (US)

(73) Assignee: Agilent Technologies, Inc., Palo Alto, CA (US)

( * ) Notice: Subject to any disclaimer, the term of this patent is extended or adjusted under 35 U.S.C. 154(b) by 0 days.

(21) Appl. No.: 10/413,855

(22) Filed: Apr. 14, 2003

(65) Prior Publication Data

US 2004/0200705 A1 Oct. 14, 2004

(51) Int. Cl.[7] ..... H01H 29/00
(52) U.S. Cl. ..... 200/182; 200/193
(58) Field of Search ..... 200/214, 220–224, 200/233–235, 228, 241, 243, 181, 182, 185, 188, 190, 191–194, 198, 199, 236, 506, DIG. 5, DIG. 43

(56) References Cited

U.S. PATENT DOCUMENTS

| | | | |
|---|---|---|---|
| 2,312,672 | A | 3/1943 | Pollard, Jr. |
| 2,564,081 | A | 8/1951 | Schilling |
| 3,430,020 | A | 2/1969 | Tomkewitsch et al. |
| 3,529,268 | A | 9/1970 | Rauterberg |
| 3,539,743 | A | 11/1970 | Winter |
| 3,600,537 | A | 8/1971 | Twyford |
| 3,639,165 | A | 2/1972 | Rairden, III |
| 3,657,647 | A | 4/1972 | Beusman et al. |
| 4,103,135 | A | 7/1978 | Gomez et al. |
| 4,200,779 | A | 4/1980 | Zakurdaev et al. |

(Continued)

FOREIGN PATENT DOCUMENTS

| | | |
|---|---|---|
| DE | 312 051 C | 5/1919 |
| EP | 0593836 A1 | 4/1994 |
| FR | 2418539 | 9/1979 |
| FR | 2458138 | 12/1980 |
| FR | 2667396 | 4/1992 |

(Continued)

OTHER PUBLICATIONS

TDB–ACC–NO: NB8406827, "Integral Power Resistors For Aluminum Substrate", IBM Technical Disclosure Bulletin, Jun. 1984, US, vol. 27, Issue No. 1B, p. 827.

(Continued)

*Primary Examiner*—Michael Friedhofer
*Assistant Examiner*—Lisa Klaus

(57) ABSTRACT

A switch has a channel plate that defines at least a portion of a number of cavities. A switching fluid is held within one or more of the cavities, and is movable between at least first and second switch states in response to forces that are applied to the switching fluid. A plurality of planar signal conductors extend from edges of the switch to within the one or more cavities holding the switching fluid, and are in wetted contact with the switching fluid. Corners in paths of the planar signal conductors may be limited to greater than 90°, about 135°, or equal to or greater than 135°. In one embodiment, signal path corners are so limited, but the planar signal conductors do not extend to the edges of the switch. In another embodiment, the one or more cavities holding the switching fluid are at least partly defined by a bent switching fluid channel.

25 Claims, 4 Drawing Sheets

U.S. PATENT DOCUMENTS 4,238,748 A 12/1980 Goullin et al.
4,245,886 A 1/1981 Kolodzey et al.
4,336,570 A 6/1982 Brower
4,419,650 A 12/1983 John
4,434,337 A 2/1984 Becker
4,475,033 A 10/1984 Willemsen et al.
4,505,539 A 3/1985 Auracher et al.
4,582,391 A 4/1986 Legrand
4,628,161 A 12/1986 Thackrey
4,652,710 A 3/1987 Karnowsky et al.
4,657,339 A 4/1987 Fick
4,742,263 A 5/1988 Harnden, Jr. et al.
4,786,130 A 11/1988 Georgiou et al.
4,797,519 A 1/1989 Elenbaas
4,804,932 A 2/1989 Akanuma et al.
4,988,157 A 1/1991 Jackel et al.
5,278,012 A 1/1994 Yamanaka et al.
5,415,026 A 5/1995 Ford
5,502,781 A 3/1996 Li et al.
5,644,676 A 7/1997 Blomberg et al.
5,675,310 A 10/1997 Wojnarowski et al.
5,677,823 A 10/1997 Smith
5,751,074 A 5/1998 Prior et al.
5,751,552 A 5/1998 Scanlan et al.
5,828,799 A 10/1998 Donald
5,841,686 A 11/1998 Chu et al.
5,849,623 A 12/1998 Wojnarowski et al.
5,874,770 A 2/1999 Saia et al.
5,875,531 A 3/1999 Nellissen et al.
5,886,407 A 3/1999 Polese et al.
5,889,325 A 3/1999 Uchida et al.
5,912,606 A 6/1999 Nathanson et al.
5,915,050 A 6/1999 Russell et al.
5,972,737 A 10/1999 Polese et al.
5,994,750 A 11/1999 Yagi
6,021,048 A 2/2000 Smith
6,180,873 B1 1/2001 Bitko
6,201,682 B1 3/2001 Mooij et al.
6,207,234 B1 3/2001 Jiang
6,212,308 B1 4/2001 Donald
6,225,133 B1 5/2001 Yamamichi et al.
6,278,541 B1 8/2001 Baker
6,304,450 B1 10/2001 Dibene, II et al.
6,320,994 B1 11/2001 Donald et al.
6,323,447 B1 11/2001 Kondoh et al.
6,351,579 B1 2/2002 Early et al.
6,356,679 B1 3/2002 Kapany
6,373,356 B1 4/2002 Gutierrez et al.
6,396,012 B1 5/2002 Bloomfield
6,396,371 B2 5/2002 Streeter et al.
6,408,112 B1 6/2002 Bartels
6,446,317 B1 9/2002 Figueroa et al.
6,453,086 B1 9/2002 Tarazona
6,470,106 B2 10/2002 McClelland et al.
6,487,333 B2 11/2002 Fouquet
6,501,354 B1 12/2002 Gutierrez et al.
6,512,322 B1 1/2003 Fong et al.
6,515,404 B1 2/2003 Wong
6,516,504 B2 2/2003 Schaper
6,559,420 B1 5/2003 Zarev
6,633,213 B1 10/2003 Dove
6,678,943 B1 * 1/2004 Feng et al. ..... 29/622
6,689,976 B1 * 2/2004 Dove et al. ..... 200/182
6,717,495 B2 * 4/2004 Kondoh et al. ..... 335/47
2002/0037128 A1 3/2002 Burger, et al.
2002/0146197 A1 10/2002 Yoon-Joong
2002/0150323 A1 10/2002 Naoki et al.
2002/0168133 A1 11/2002 Saito
2003/0035611 A1 2/2003 Shi

FOREIGN PATENT DOCUMENTS

JP 36-18575 10/1961
JP 47-21645 10/1972
JP 62-276838 12/1987
JP 63-294317 12/1988
JP 8-125487 5/1996
JP 9-161640 6/1997
WO WO99-46624 9/1999

OTHER PUBLICATIONS

Bhedwar, Homi C., et al. "Ceramic Multilayer Package Fabrication", Electronic Materials Handbook, Nov. 1989, pp 460–469, vol. 1 Packaging, Section 4: Packages.

Kim, Joonwon, et al., "A Micromechanical Switch With Electrostatically Driven Liquid–Metal Droplet", Sensors and Actuators, A; Physical v 9798, Apr. 1, 2002, 4 pages.

Marvin Glenn Wong, U.S. patent application Ser. No. 10/137,691 (pending), "A piezoelectrically Actuated Liquid Metal Switch", May 2, 2002.

J. Simon, et al., "A Liquid–Filled Microrelay with a Moving Mercury Microdrop", Journal of Microelectromechanical Systems. vol. 6, No. 3, Sep. 1997. pp. 208–216.

Marvin Glenn Wong, et al., New U.S. patent application (13 pages specification, 5 pages of claims, 1 page abstract, and 4 sheets of drawings), "Bent Switching Fluid Cavity", Filed Apr. 14, 2003.

* cited by examiner

FORMATION OF SIGNAL PATHS TO INCREASE MAXIMUM SIGNAL-CARRYING FREQUENCY OF A FLUID-BASED SWITCH

CROSS-REFERENCE TO RELATED APPLICATIONS

This application is related to U.S. patent application Ser. No. 10/414,343 of Marvin Glenn Wong, et al. filed on the Apr. 14, 2003 entitled "Bent Switching Fluid Cavity" (which is hereby incorporated by reference).

BACKGROUND

Fluid-based switches such as liquid metal micro switches (LIMMS) have proved to be valuable in environments where fast, clean switching is desired. The maximum signal-carrying frequencies of these switches depend on many factors, including 1) the time required to propagate any signals that cause the switch's switching fluid to assume a desired state, and 2) the time required to propagate a signal through the switch's current state. Any development that decreases either or both of these times is desirable.

SUMMARY OF THE INVENTION

One aspect of the invention is embodied in a switch. The switch comprises a channel plate that defines at least a portion of a number of cavities. A switching fluid is held within one or more of the cavities, and is movable between at least first and second switch states in response to forces that are applied to the switching fluid. A plurality of planar signal conductors extend from edges of the switch to within the one or more cavities holding the switching fluid. The planar signal conductors are in wetted contact with the switching fluid.

Another aspect of the invention is embodied in a device comprising a substrate and a switch. The switch is mounted on the substrate and is electrically coupled to one or more conductive elements on the substrate. The switch is configured as described in the preceding paragraph.

Yet another aspect of the invention is also embodied in a switch. The switch comprises a channel plate that defines at least a portion of a number of cavities. A switching fluid is held within one or more of the cavities, and is movable between at least first and second switch states in response to forces that are applied to the switching fluid. The switch further comprises a plurality of surface contacts, and a plurality of conductive vias that are electrically coupled to corresponding ones of the plurality of surface contacts. A plurality of planar signal conductors extend from corresponding ones of the conductive vias to within the one or more cavities holding the switching fluid. The planar signal conductors are in wetted contact with the switching fluid. A path taken by one of the planar signal conductors comprises a corner, and the tightest corner in a path taken by any of the planar signal conductors is about 135°.

Other embodiments of the invention are also disclosed.

BRIEF DESCRIPTION OF THE DRAWINGS

Illustrative embodiments of the invention are illustrated in the drawings, in which.

DETAILED DESCRIPTION OF THE INVENTION

Figure 3:
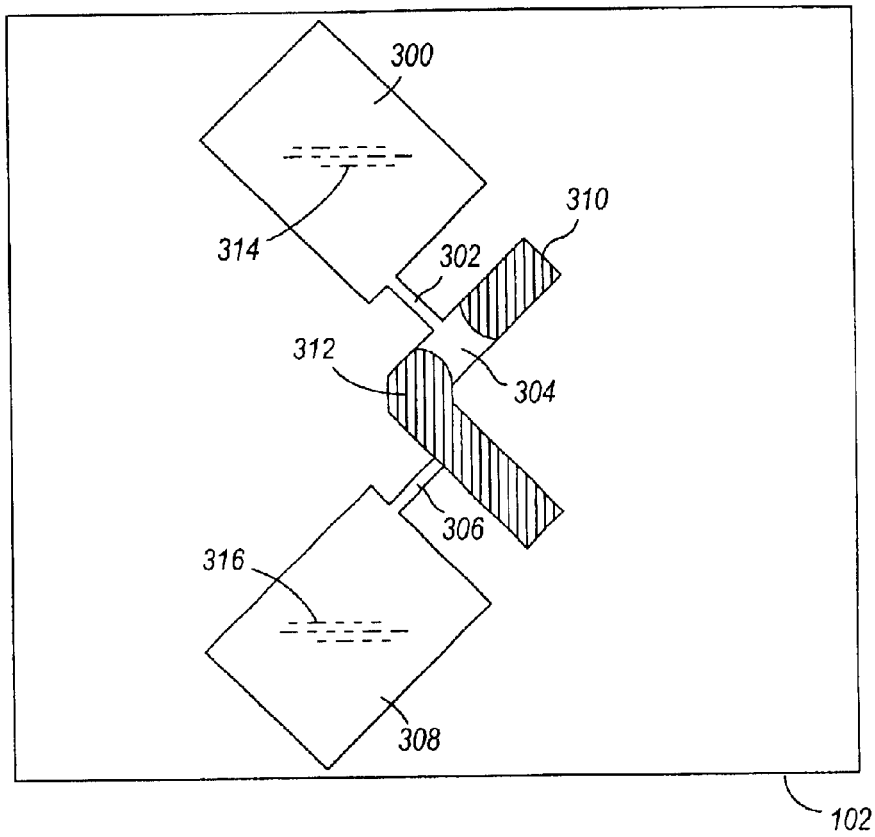
FIG. 3 is a plan view of the channel plate of the switch shown in FIG. 1.

FIGS. 1–5 illustrate a first exemplary embodiment of a switch 100. The switch comprises a channel plate 102 that defines at least a portion of a number of cavities 300, 302, 304, 306, 308 (FIG. 3). One or more of the cavities may be at least partly defined by a switching fluid channel 310 in the channel plate 102. The remaining portions of the cavities 300–308, if any, may be defined by a substrate 104 that is mated and sealed to the channel plate 102. See FIG. 2.

The channel plate 102 and substrate 104 may be sealed to one another by means of an adhesive, gasket, screws (providing a compressive force), and/or other means. One suitable adhesive is Cytop™ (manufactured by Asahi Glass Co., Ltd. of Tokyo, Japan). Cytop™ comes with two different adhesion promoter packages, depending on the application. When a channel plate 102 has an inorganic composition, Cytop™'s inorganic adhesion promoters should be used. Similarly, when a channel plate 102 has an organic composition, Cytop™'s organic adhesion promoters should be used.

Figure 1:
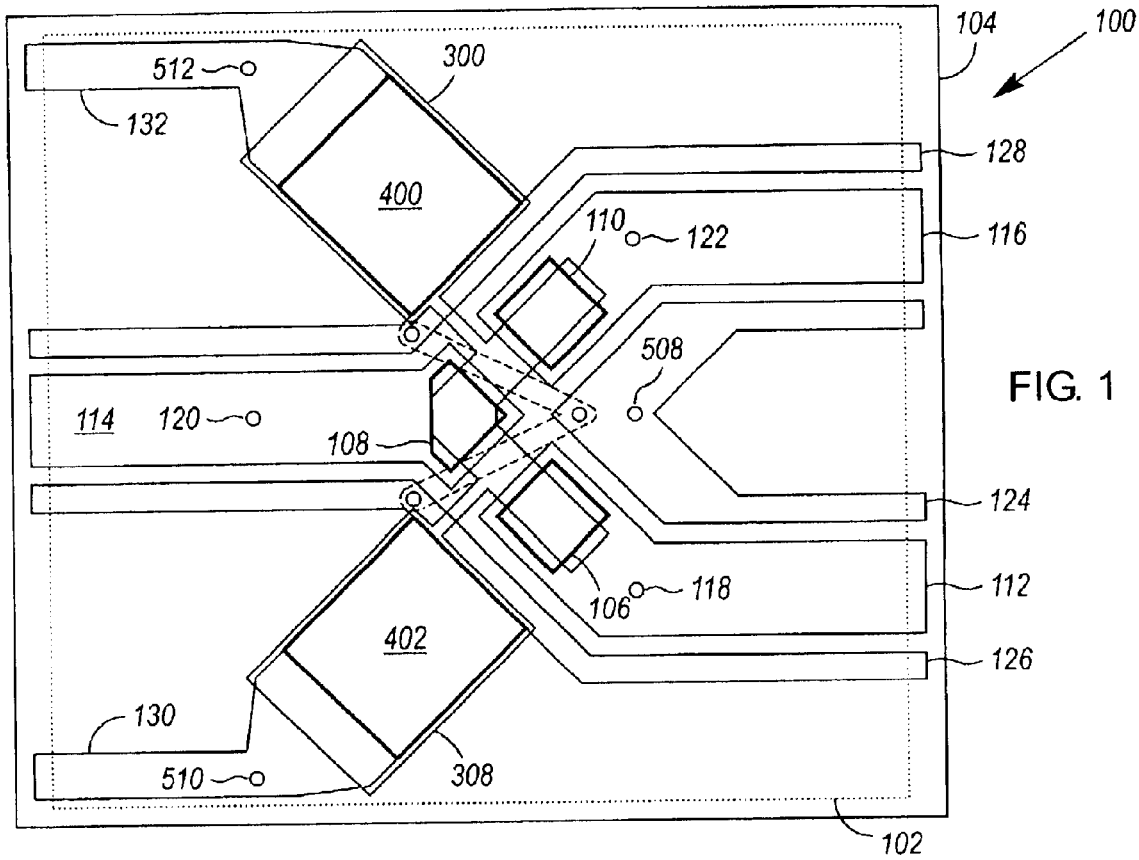
FIG. 1 is a plan view of a first exemplary embodiment of a switch.
Figure 2:
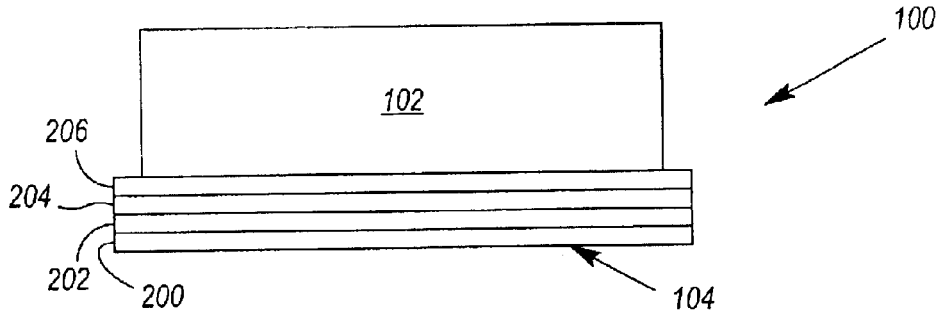
FIG. 2 illustrates an elevation of the layers of the switch shown in FIG. 1.
Figure 4:
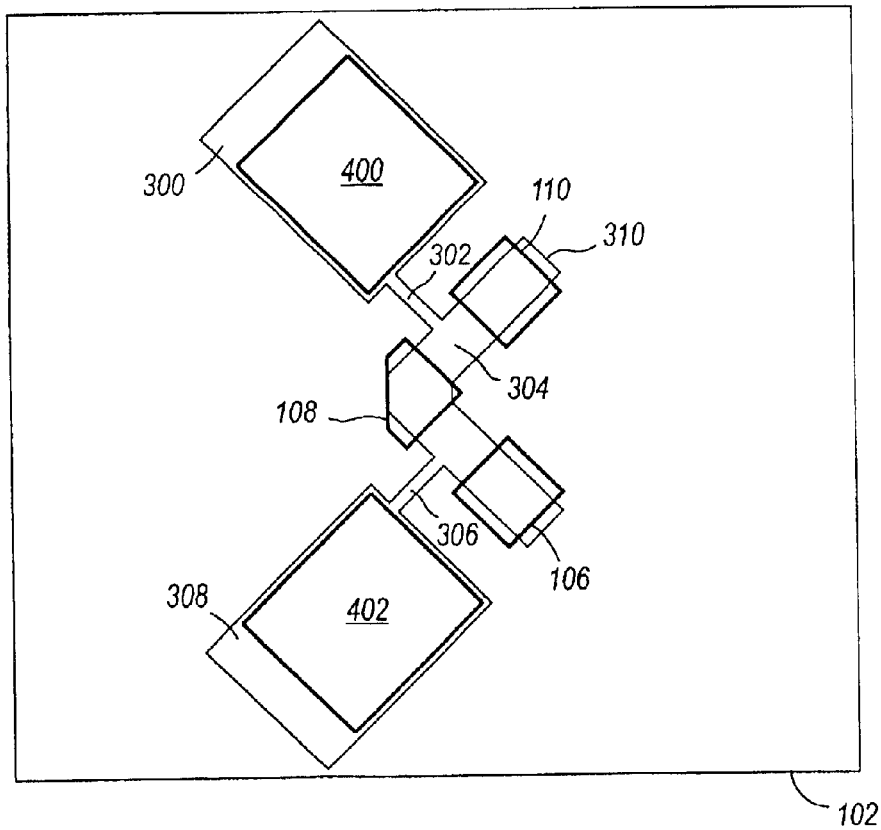
FIG. 4 is a plan view showing a correspondence of elements in/on the channel plate and substrate of the switch shown in FIG. 1.

As shown in FIG. 3, a switching fluid 312 (e.g., a conductive liquid metal such as mercury) is held within the cavity 304 defined by the switching fluid channel 310. The switching fluid 312 is movable between at least first and second switch states in response to forces that are applied to the switching fluid 312. FIG. 3 illustrates the switching fluid 312 in a first state. In this first state, there is a gap in the switching fluid 312 in front of cavity 302. The gap is formed as a result of forces that are applied to the switching fluid 312 by means of an actuating fluid 314 (e.g., an inert gas or liquid) held in cavity 300. In this first state, the switching fluid 312 wets to and bridges contact pads 106 and 108 (FIGS. 1 & 4). The switching fluid 312 may be placed in a second state by decreasing the forces applied to it by means of actuating fluid 314, and increasing the forces applied to it by means of actuating fluid 316. In this second state, a gap is formed in the switching fluid 312 in front of cavity 306, and the gap shown in FIG. 3 is closed. In this second state, the switching fluid 312 wets to and bridges contact pads 108 and 110 (FIGS. 1 & 4).

Figure 5:
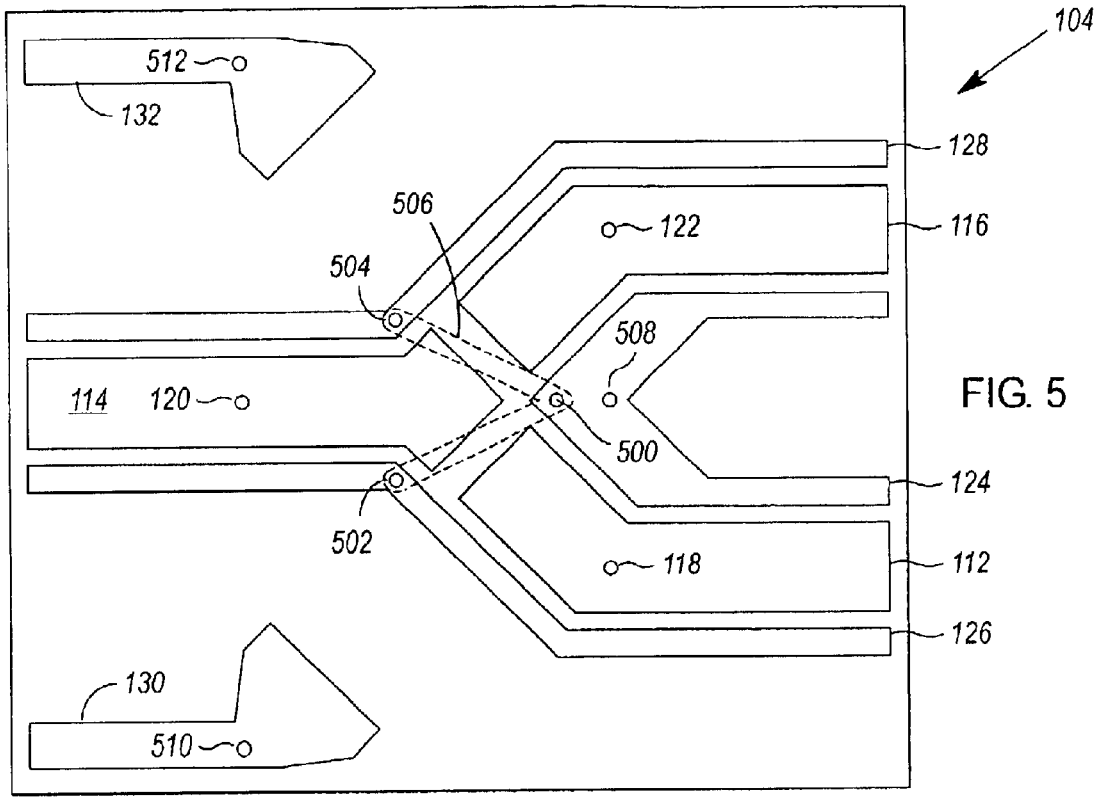
FIG. 5 is a plan view of the substrate of the switch shown in FIG. 1.

As shown in FIGS. 1 & 5, a plurality of planar signal conductors 112, 114, 116 extend from edges of the switch 100 to within the cavity 304 defined by the switching fluid channel 310. When the switch 100 is assembled, these conductors 112–116 are in wetted contact with the switching fluid 312. The ends of the planar signal conductors 112–116 to which the switching fluid 312 wets may be plated (e.g., with Gold or Copper), but need not be. The ends of the planar signal conductors 112–116 that extend to the edges of the switch 100 may extend exactly to the edge of the switch 100, or may extend to within a short distance of the exact edge of the switch 100 (as shown in FIG. 1). For purposes of this description, the conductors 112–116 are considered to extend to a switch's "edges" in either of the above cases.

Figure 6:
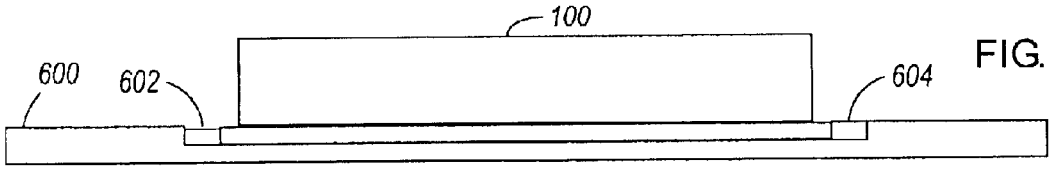
FIGS. 6–9 illustrate various ways to couple the switch shown in FIG. 1 to a substrate.

Ideally, the switch 100 would be mounted to a substrate 600 (e.g., a printed circuit board) as shown in FIG. 6, such that the switch's planar signal conductors 112–116 are coplanar with the conductive elements on a substrate 600 to which they need to be electrically coupled. In this manner, coplanar wirebonds 602, 604 (such as ribbon wirebonds) could be used to couple the switch's planar signal conductors 112–116 to the substrate's conductive elements.

Use of the planar signal conductors 112–116 for signal propagation eliminates the routing of signals through vias, and thus eliminates up to four right angles that a signal would formerly have had to traverse (i.e., a first right angle where a switch input via 120 is coupled to a substrate, perhaps at a solder ball or other surface contact; a second right angle where the switch input via 120 is coupled to internal switch circuitry 114; a third right angle where the internal switch circuitry 116 is coupled to a switch output via 122; and a fourth right angle where the switch output via 122 is coupled to the substrate). Elimination of these right angles eliminates a cause of unwanted signal reflection, and reductions in unwanted signal reflection tend to result in signals propagating more quickly through the affected signal paths.

Figure 8:
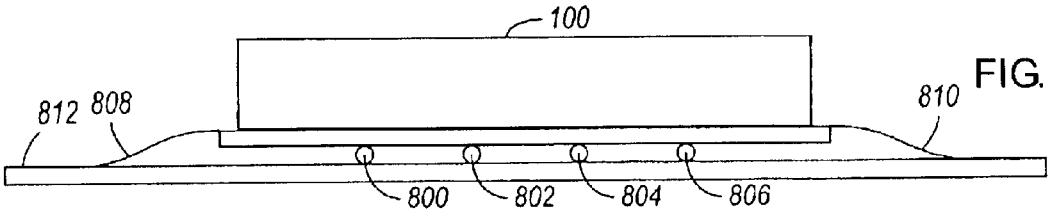

Realizing that not all environments may be conducive to edge coupling of the switch 100, the switch 100 may also be provided with a plurality of conductive vias 118, 120, 122 for electrically coupling the planar signal conductors 112–116 to a plurality of surface contacts such as solder balls (see solder balls 800, 806 in FIG. 8, for example). Alternately, the vias 118–122 could couple the planar signal conductors 112–116 to other types of surface contacts (e.g., pins, or pads of a land grid array (LGA)).

To further increase the speed at which signals may propagate through the switch 100, a number of planar ground conductors 124, 126, 128 may be formed adjacent either side of each planar signal conductor 112–116 (FIGS. 1 & 5). The planar signal and ground conductors 112–116, 124–128 form a planar coaxial structure for signal routing, and 1) provide better impedance matching, and 2) reduce signal induction at higher frequencies.

As shown in FIGS. 1 & 5, a single ground conductor may bound the sides of more than one of the signal conductors 112–116 (e.g., ground conductor 124 bounds sides of signal conductors 112 and 116). Furthermore, the ground conductors 124–128 may be coupled to one another within the switch 100 for the purpose of achieving a uniform and more consistent ground. If the substrate 104 comprises alternating metal and insulating layers 200–206 (FIG. 2), then the ground conductors 124–128 may be formed in a first metal layer 206, and may be coupled to a V-shaped trace 506 in a second metal layer 202 by means of a number of conductive vias 500, 502, 504 formed in an insulating layer 204.

Similarly to the planar signal conductors 112–116, the planar ground conductors 124–128 may extend to the edges of the switch 100 so that they may be coupled to a printed circuit board or other substrate via wirebonds. However, again realizing that not all environments may be conducive to edge coupling of the switch 100, the ground conductors 124–128 may also be coupled to a number of conductive vias 508 that couple the ground conductors 124–128 to a number of surface contacts of the switch 100.

In the prior description, it was disclosed that switching fluid 312 could be moved from one state to another by forces applied to it by an actuating fluid 314, 316 held in cavities 300, 308. However, it has yet to be disclosed how the actuating fluid 314, 316 is caused to exert a force (or forces) on switching fluid 312. One way to cause an actuating fluid (e.g., actuating fluid 314) to exert a force is to heat the actuating fluid 314 by means of a heater resistor 400 that is exposed within the cavity 300 that holds the actuating fluid 314. As the actuating fluid 314 is heated, it tends to expand, thereby exerting a force against switching fluid 312. In a similar fashion, actuating fluid 316 can be heated by means of a heater resistor 402. Thus, by alternately heating actuating fluid 314 or actuating fluid 316, alternate forces can be applied to the switching fluid 312, causing it to assume one of two different switching states. Additional details on how to actuate a fluid-based switch by means of heater resistors are described in U.S. Pat. No. 6,323,447 of Kondoh et al. entitled "Electrical Contact Breaker Switch, Integrated Electrical Contact Breaker Switch, and Electrical Contact Switching Method", which is hereby incorporated by reference.

Figure 10:
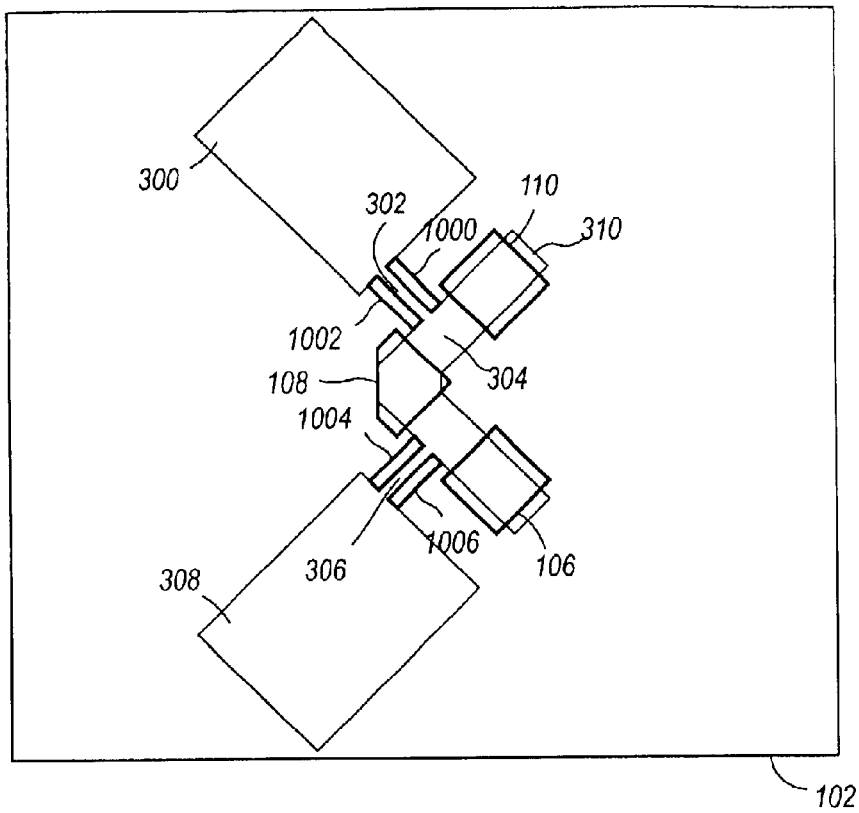
FIG. 10 is a plan view illustrating a first alternate embodiment of the switch shown in FIG. 1.

Another way to cause an actuating fluid 314 to exert a force is to decrease the size of the cavities 300, 302 that hold the actuating fluid 314. FIG. 10 therefore illustrates an alternative embodiment of the switch 100, wherein heater resistors 400, 402 are replaced with a number of piezoelectric elements 1000, 1002, 1004, 1006 that deflect into cavities 302, 306 when voltages are applied to them. If voltages are alternately applied to the piezoelectric elements 1000, 1002 exposed within cavity 302, and the piezoelectric elements 1004, 1006 exposed within cavity 306, alternate forces can be applied to the switching fluid 312, causing it to assume one of two different switching states. Additional details on how to actuate a fluid-based switch by means of piezoelectric pumping are described in U.S. patent application Ser. No. 10/137,691 of Marvin Glenn Wong filed May 2, 2002 and entitled "A Piezoelectrically Actuated Liquid Metal Switch", which is hereby incorporated by reference.

Although the above referenced patent and patent application disclose the movement of a switching fluid by means of dual push/pull actuating fluid cavities, a single push/pull actuating fluid cavity might suffice if significant enough push/pull pressure changes could be imparted to a switching fluid from such a cavity.

To enable faster cycling of the afore-mentioned heater resistors 400, 402 or piezoelectric elements 1000–1006, each may be coupled between a pair of planar conductors 130/126, 132/128 that extend to a switch's edges. As shown in FIG. 1, some of these planar conductors 126, 128 may be the planar ground conductors that run adjacent to the planar signal conductors 112–116. If desired, conductive vias 510, 512 may be provided for coupling these conductors 130, 132 to surface contacts on the switch 100.

Figure 11:
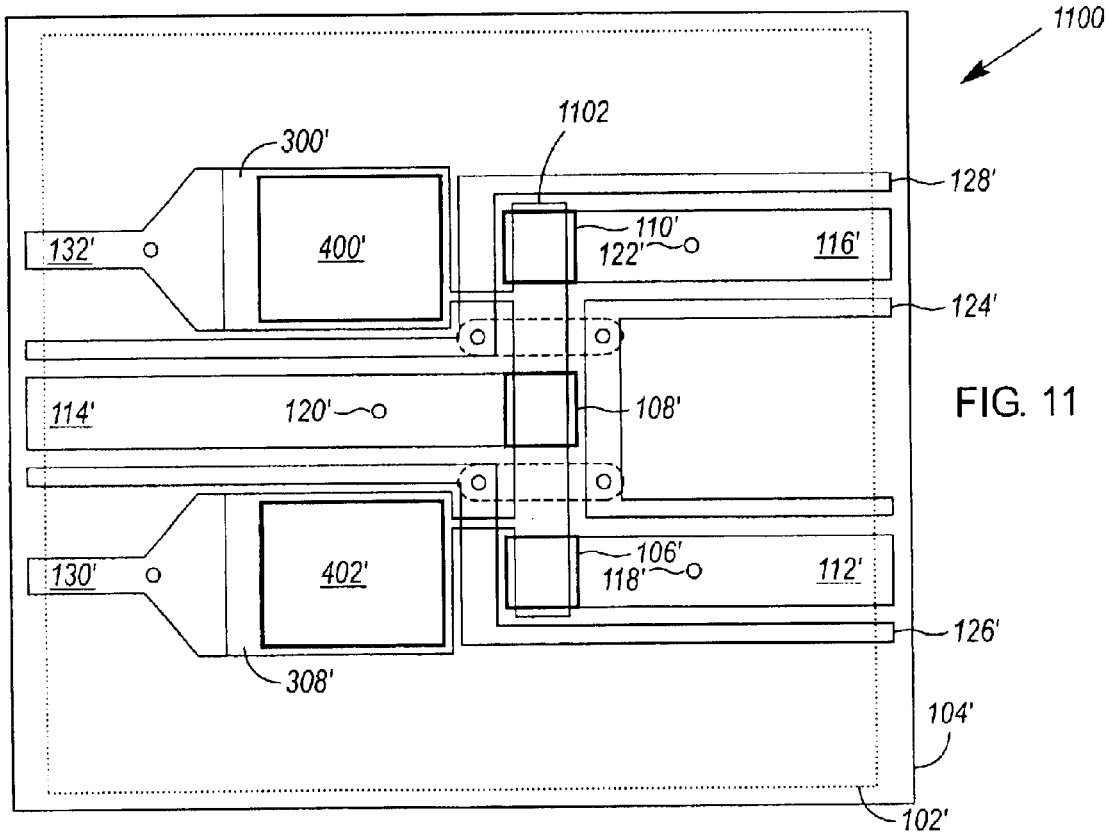
FIG. 11 is a plan view illustrating a second alternate embodiment of the switch shown in FIG. 1.

Although the switching fluid channel 310 shown in FIGS. 1, 3 & 4 comprises a bend, the channel need not. A switch 1100 comprising a straight switching channel 1102 is shown in FIG. 11 (other elements shown in FIG. 11 correspond to elements shown in FIG. 1, and are referenced by the prime (') of the reference numbers used in FIG. 1—i.e., 102'–132', 300', 308', 400' & 402'). If a bent switching fluid channel 310 is used, one planar signal conductor 114 may present within the cavity 304 defined by the switching fluid channel 310 "at" the bend, and additional ones of the planar signal conductors 112, 116 may present within the cavity 304 "on either side of" the bend. An advantage provided by the bent switching fluid channel 310 is that signals propagating into and out of the switching fluid 312 held therein need not take right angle turns. Thus, in an ideal connection environment, the switch 100 illustrated in FIGS. 1–5 can be used to eliminate all right angle turns in signal paths, thereby reducing signal reflections, increasing the speed at which signals can propagate through the switch, and ultimately increasing the maximum signal-carrying frequency of the switch 100.

To make it easier to couple signal routes to the switch 100, it may be desirable to group signal inputs on one side of the switch, and group signal outputs on another side of the switch. If this is done, it is preferable to limit the tightest corner taken by a path of any of the planar signal conductors to greater than 90°, or more preferably to about 135°, and even more preferably to equal to or greater than 135° (i.e., to reduce the number of signal reflections at conductor corners).

By way of example, the switch 100 illustrated in FIGS. 1–5 may be coupled to the substrate (e.g., a printed circuit board) of a larger device as shown in any of FIGS. 6–9.

In FIG. 6, the switch 100 is mechanically coupled to a substrate 600 by means of an adhesive, solder, socket or other means. However, all electrical connections between the switch 100 and substrate 600 are made by wirebonds 602, 604 (e.g., ribbon wirebonds) that are coplanar with 1) the planar signal conductors 112–116 of the switch 100, and 2) conductive elements on the substrate 600.

Figure 7:
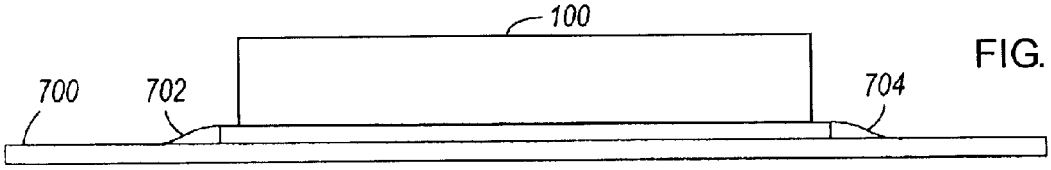

In FIG. 7, the switch 100 is mechanically coupled to a substrate 700 by means of an adhesive, solder, socket or other means, but electrical connections between the switch 100 and conductive elements on the substrate 700 (e.g., traces on the substrate) are made by means of wirebonds (e.g., ribbon wirebonds).

In the configurations shown in FIGS. 6 & 7, it should be noted that the conductive vias 118–122, 508–512 shown in FIGS. 1 & 5 could be eliminated to keep signal inductance to a minimum, thereby increasing the maximum signal-carrying frequency of the switch 100.

In FIG. 8, the switch 100 is mechanically coupled to a substrate 812 by means of solder balls (e.g., of a ball grid array (BGA)), but electrical connections between the switch 100 and conductive elements on the substrate 812 are made by a combination of solder balls 800–806 and wirebonds 808, 810. Preferably, at least the planar signal conductors 112–116 are coupled to conductive elements on the substrate 812 by means of wirebonds 808, 810. However, the planar conductors 126–132 coupled to heater resistors 400, 402 (or the piezoelectric elements 1000–1006 shown in FIG. 10) and/or the planar ground conductors 124–128 may be coupled to conductive elements on the substrate 812 via solder balls 800–806.

Figure 9:
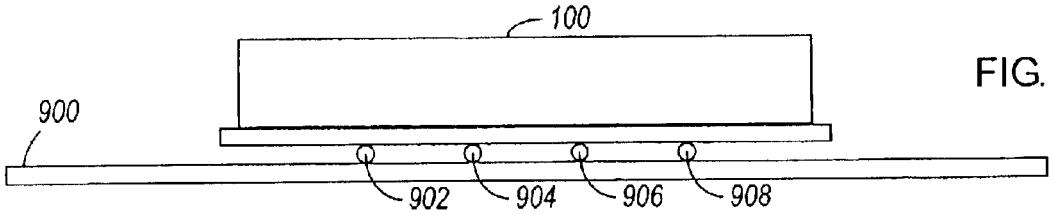

In FIG. 9, the switch 100 is both mechanically and electrically coupled to the substrate 900 via surface contacts (e.g., solder balls 902, 904, 906, 908). In this configuration, the planar conductors 112–116, 124–132 need not extend to the edges of the switch 100. However, the switch 100 can still benefit from signal paths with acute angle corners and/or a bent switching fluid channel 310, even though signals will need to propagate into the switch 100 via right angle turns at solder balls 902–908 and conductive vias 118–122, 508–512.

It is envisioned that the switch mounting configurations shown in FIGS. 6 & 7 will likely be used in applications where higher signal-carrying frequencies are needed, and the switch mounting configurations illustrated in FIGS. 8 & 9 will likely be used in applications where somewhat more moderate signal-carrying frequencies are sufficient.

Although the above description has been presented in the context of the switches 100, 1100 shown and described herein, application of the inventive concepts is not limited to the fluid-based switches shown herein.

While illustrative and presently preferred embodiments of the invention have been described in detail herein, it is to be understood that the inventive concepts may be otherwise variously embodied and employed, and that the appended claims are intended to be construed to include such variations, except as limited by the prior art.

What is claimed is:

1. A switch, comprising:

a) a channel plate defining at least a portion of a number of cavities;

b) a switching fluid, held within one or more of the cavities, that is movable between at least first and second switch states in response to forces that are applied to the switching fluid; and c) a plurality of planar signal conductors extending from edges of the switch to within the one or more cavities holding the switching fluid, and in wetted contact with the switching fluid.

2. The switch of claim 1, wherein:

a) the one or more cavities holding the switching fluid are at least partly defined by a bent switching fluid channel in the channel plate;

b) one of the planar signal conductors presents within the cavity defined by the bent switching fluid channel at the bend; and c) different ones of the planar signal conductors present within the cavity defined by the bent switching fluid channel on either side of the bend.

3. The switch of claim 2, wherein the tightest corner in a path taken by any of the planar signal conductors is about 135°; the switch further comprising planar ground conductors adjacent either side of each planar signal conductor.

4. The switch of claim 1, wherein a path taken by one of the planar signal conductors comprises a corner, and wherein a tightest corner in a path taken by any of the planar signal conductors is greater than 90°.

5. The switch of claim 4, wherein the tightest corner in a path taken by any of the planar signal conductors is about 135°.

6. The switch of claim 4, wherein the tightest corner in a path taken by any of the planar signal conductors is equal to or greater than 135°.

7. The switch of claim 1, further comprising planar ground conductors adjacent either side of each planar signal conductor.

8. The switch of claim 1, further comprising:

a) a plurality of surface contacts; and b) a plurality of conductive vias that electrically couple ones of the planar signal conductors to the surface contacts.

9. The switch of claim 1, further comprising:

a) an actuating fluid to apply said forces to the switching fluid, held within one or more of the cavities;

b) one or more heater resistors, exposed within cavities holding the actuating fluid; and c) a pair of planar conductors extending from edges of the switch to each heater resistor.

10. The switch of claim 9, wherein one of the planar conductors coupled to each heater resistor is a planar ground conductor that runs adjacent to one of the planar signal conductors.

11. The switch of claim 1, further comprising:

a) an actuating fluid to apply said forces to the switching fluid, held within one or more of the cavities;

b) one or more piezoelectric elements, exposed within cavities holding the actuating fluid; and c) a pair of planar conductors extending from edges of the switch to each piezoelectric element.

12. The switch of claim 11, wherein one of the planar conductors coupled to each piezoelectric element is a planar ground conductor that runs adjacent to one of the planar signal conductors.

13. A switch, comprising:

a) a channel plate defining at least a portion of a number of cavities;

b) a switching fluid, held within one or more of the cavities, that is movable between at least first and second switch states in response to forces that are applied to the switching fluid;

c) a plurality of surface contacts;

d) a plurality of conductive vias, electrically coupled to corresponding ones of the plurality of surface contacts; and e) a plurality of planar signal conductors extending from corresponding ones of the conductive vias to within the one or more cavities holding the switching fluid, and in wetted contact with the switching fluid; wherein a path taken by one of the planar signal conductors comprises a corner, and wherein a tightest corner in a path taken by any of the planar signal conductors is about 135°.

14. The switch of claim 13, wherein:

a) the one or more cavities holding the switching fluid are at least partly defined by a bent switching fluid channel in the channel plate;

b) one of the planar signal conductors presents within the cavity defined by the bent switching fluid channel at the bend; and c) different ones of the planar signal conductors present within the cavity defined by the bent switching fluid channel on either side of the bend.

15. The switch of claim 13, wherein the tightest corner in a path taken by any of the planar signal conductors is equal to or greater than 135°.

16. The switch of claim 13, further comprising planar ground conductors adjacent either side of each planar signal conductor.

17. A device, comprising:

a) a substrate; and b) a switch, mounted on the substrate and electrically coupled to one or more conductive elements on the substrate, comprising:

i) a channel plate defining at least a portion of a number of cavities;

ii) a switching fluid, held within one or more of the cavities, that is movable between at least first and second switch states in response to forces that are applied to the switching fluid; and iii) a plurality of planar signal conductors extending from edges of the switch to within the one or more cavities holding the switching fluid, and in wetted contact with the switching fluid.

18. The device of claim 17, further comprising wirebonds coupling the plurality of planar signal conductors to conductive elements on the substrate.

19. The device of claim 18, wherein the switch further comprises:

a) an actuating fluid to apply said forces to the switching fluid, held within one or more of the cavities;

b) one or more heater resistors, exposed within cavities holding the actuating fluid;

c) a plurality of conductive vias; and d) a pair of planar conductors extending between each heater resistor and ones of said conductive vias; the device further comprising solder balls coupling the conductive vias to conductive elements on the substrate.

20. The device of claim 18, wherein the switch further comprises:

a) an actuating fluid to apply said forces to the switching fluid, held within one or more of the cavities;

b) one or more heater resistors, exposed within cavities holding the actuating fluid; and c) a pair of planar conductors extending from edges of the switch to each heater resistor;

the device further comprising wirebonds coupling each heater resistor's planar conductors to conductive elements on the substrate.

21. The device of claim 18, wherein the switch further comprises:

a) an actuating fluid to apply said forces to the switching fluid, held within one or more of the cavities;

b) one or more piezoelectric elements, exposed within cavities holding the actuating fluid;

c) a plurality of conductive vias; and d) a pair of planar conductors extending between each piezoelectric element and ones of said conductive vias;

the device further comprising solder balls coupling the conductive vias to conductive elements on the substrate.

22. The device of claim 18, wherein the switch further comprises:

a) an actuating fluid to apply said forces to the switching fluid, held within one or more of the cavities;

b) one or more piezoelectric elements, exposed within cavities holding the actuating fluid; and c) a pair of planar conductors extending from edges of the switch to each piezoelectric element;

the device further comprising wirebonds coupling each piezoelectric element's planar conductors to conductive elements on the substrate.

23. The device of claim 18, wherein the planar signal conductors of the switch are coplanar with conductive elements on the substrate to which they are electrically coupled.

24. The device of claim 18, wherein the switch further comprises planar ground conductors adjacent either side of each planar signal conductor.

25. The device of claim 24, further comprising wirebonds coupling the planar ground conductors to conductive elements on the substrate.

* * * * *